United States Patent [19]

Gouye et al.

[11] 3,972,781

[45] Aug. 3, 1976

[54] SCRAPER FOR THE LID AND LID SEAT OF A COKE OVEN ASCENSION PIPE

[75] Inventors: Emmanuel V. Gouye, Pittsburgh; Gerald S. Radaci, Munhall, both of Pa.

[73] Assignee: Koppers Company, Inc., Pittsburgh, Pa.

[22] Filed: Aug. 26, 1974

[21] Appl. No.: 500,532

[52] U.S. Cl. ..... 202/241; 15/93 A; 15/246.5

[51] Int. Cl.[2] ..... B23D 79/06; C10B 43/06

[58] Field of Search ..... 202/241; 201/2; 208/48 R; 15/93 A, 246.5; 51/241 S, 241 VS

[56] References Cited

UNITED STATES PATENTS

| | | | |
|---|---|---|---|
| 2,218,130 | 10/1940 | Court | 202/241 X |
| 2,268,723 | 1/1942 | Scherer | 51/241 VS |
| 2,360,009 | 10/1944 | Norton | 51/241 VS |
| 3,160,573 | 12/1964 | Nepomniashtshy | 202/241 |
| 3,196,088 | 7/1965 | Coleman et al. | 202/241 |
| 3,281,880 | 11/1966 | Bender | 15/93 A |
| 3,480,514 | 11/1969 | Kinzler et al. | 202/241 |
| 3,822,191 | 7/1974 | Konno | 202/241 |

FOREIGN PATENTS OR APPLICATIONS

| | | | |
|---|---|---|---|
| 1,281,998 | 11/1960 | France | 202/241 |

*Primary Examiner*—Morris O. Wolk
*Assistant Examiner*—Bradley R. Garris
*Attorney, Agent, or Firm*—Sherman H. Barber; Olin E. Williams; Oscar B. Brumback

[57] ABSTRACT

Apparatus for cleaning ascension pipe lids and lid seats comprises a pivotable tool holder mounted to a larry car and the tool holder carries two sets of cleaning tools. One set is rotatable for cleaning the lid seat in the ascension pipe opening and the other set is rotatable for cleaning the ascension pipe lid. The other set of cleaning tools is retractable when not in use. The tool holder is manually or mechanically operable.

14 Claims, 4 Drawing Figures

SCRAPER FOR THE LID AND LID SEAT OF A COKE OVEN ASCENSION PIPE

BRIEF SUMMARY OF THE INVENTION

In a coke oven battery wherein a larry car travels there is a support mounted to the larry car and a platform is swivelly caried by the support. A guide is mounted to the the platform and a frame is pivotally mounted to the platform. A rod is slidably disposed in the guide and is pivotally connected to the frame. The rod carries a support on which is mounted a rotatable element having an output shaft to which is mounted a support. First cleaning tools are carried by the support and second adjustably mounted tools are carried by the support. Means is provided for reciprocating the rod so that the tools engage and disengage from a workpiece.

For a further understanding of the invention and for features and advantages thereof, reference may be made to the following description and the drawing which illustrates a preferred embodiment and a modification thereof, of equipment in accordance with the invention.

DETAILED DESCRIPTION

Figure 1:
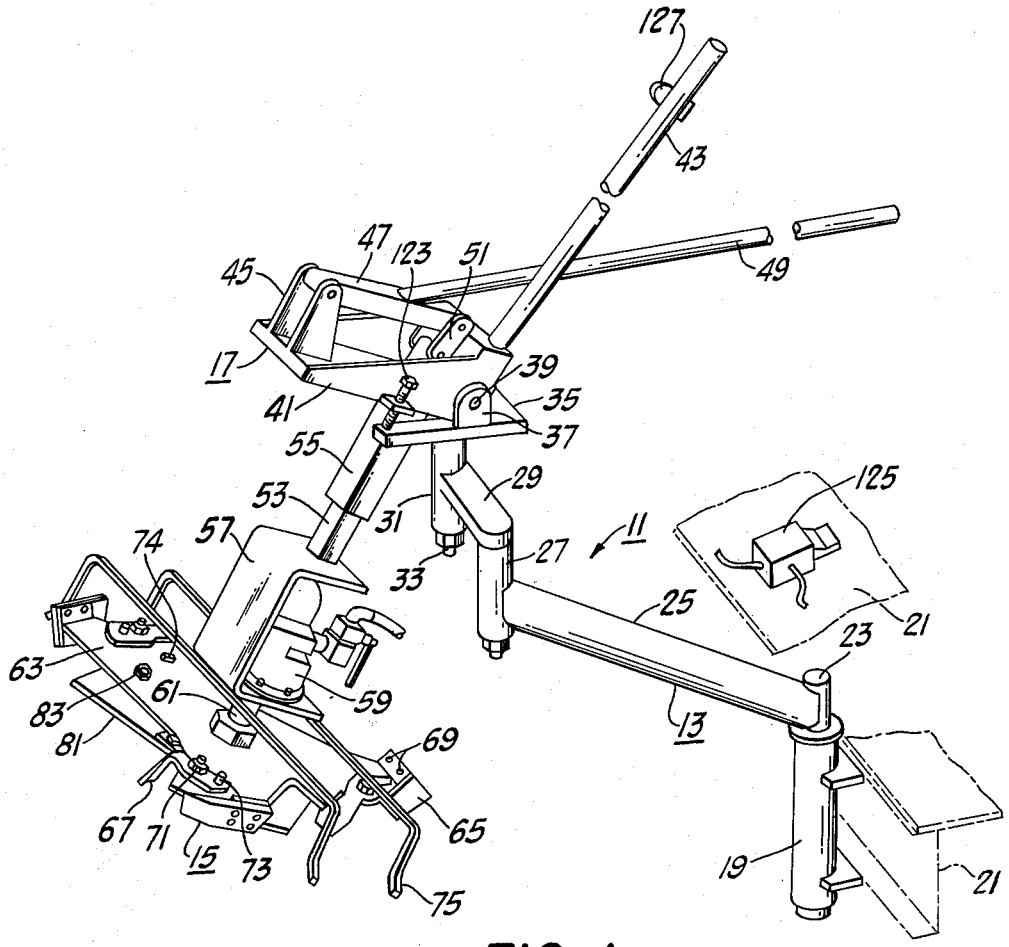
FIG. 1 is a schematic perspective view of apparatus in accordance with the invention.

Referring to FIG. 1, apparatus 11 in accordance with the invention includes a support structure 13; a cleaning head mechanism 15; and a mechanism 17 for actuating the cleaning head 15.

The support structure 13 includes a sleeve 19 that is fixed to a coventional larry car 21, and it supports a pivotable pin 23 journaled therein. To the pin 23 there is connected an arm 25 which carries at its free end a similar sleeve 27 with a pin on which is mounted a second arm 29. The arm 29 also carries at its free end a sleeve 31 that surrounds a pin 33. The pin 33 carries on its upper end a platform 35. The platform 35, as shown, carries the actuating mechanism 17, described hereinafter.

The platform 35 in generally U-shaped having attached to the parallel legs thereof lugs 37 in which is journaled a pivot shaft 39.

The pivot shaft 39 supports a vertical pivoting frame 41. The pivoting frame 41 is fixed to one end of an operating lever 43 and also carries lugs 45 to which is journaled a link mechanism 47. To the link mechanism 47 is attached one end of another actuating lever 49 and short connecting links 51 that carry one end of a rectangular-sectioned slidable rod 53.

The rod 53 is slidable in a hollow tube 55 which is secured, as by welding, to the pivoting frame 41. The rod 53 carries at its lower end an open frame 57 to which is mounted an air operated motor 59, though other types of motors may be used if preferred. An output shaft 61 of the air motor supports a plate 63 on which are mounted two sets of cleaing devices 65, 67.

The first set of cleaning devices 65 comprises three chisel-shaped blocks that are fixedly bolted, as at 69, to the plate 63; the blocks being located apart at angles of 120° from each other.

The second set of cleaning devices 67 comprises three pivotally mounted blades that are located apart at angles of 120° from each other and that are spaced apart angularly from the cleaing devices 65. The cleaning devices 67 are pivotal about a bolt 71 that, by means of a lock washer or other suitable device, frictionally holds the cleaning device in a preselected operative or inoperative position. A pin 73 on the cleaning device affords means for manually or mechanically pivoting the cleaning devices 67 from one position to another. A suitable lug or stop 74 is welded to the plate 63 near each cleaning device 67, about where shown, and such stops maintain the cleaning devices 67 in their operative positions.

Fixed to the bottom of the frame 57 are two elongate shaped guides 75 that orient the cleaning mechanism in position relative to an ascension pipe opening 77 and to an ascension pipe lid 79.

Figure 2:
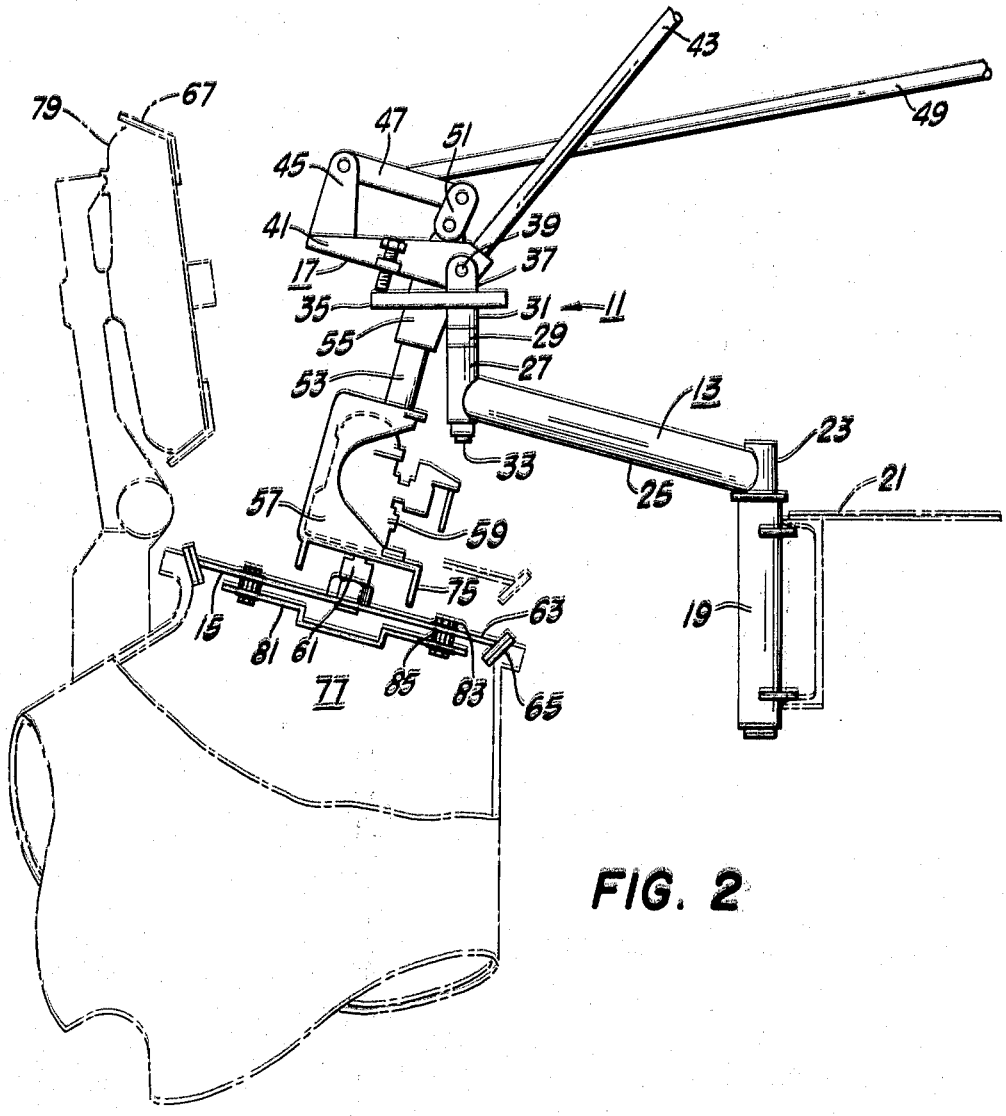
FIG. 2 is an elevational view of the apparatus of FIG. 1 showing it in one position for use.
Figure 3:
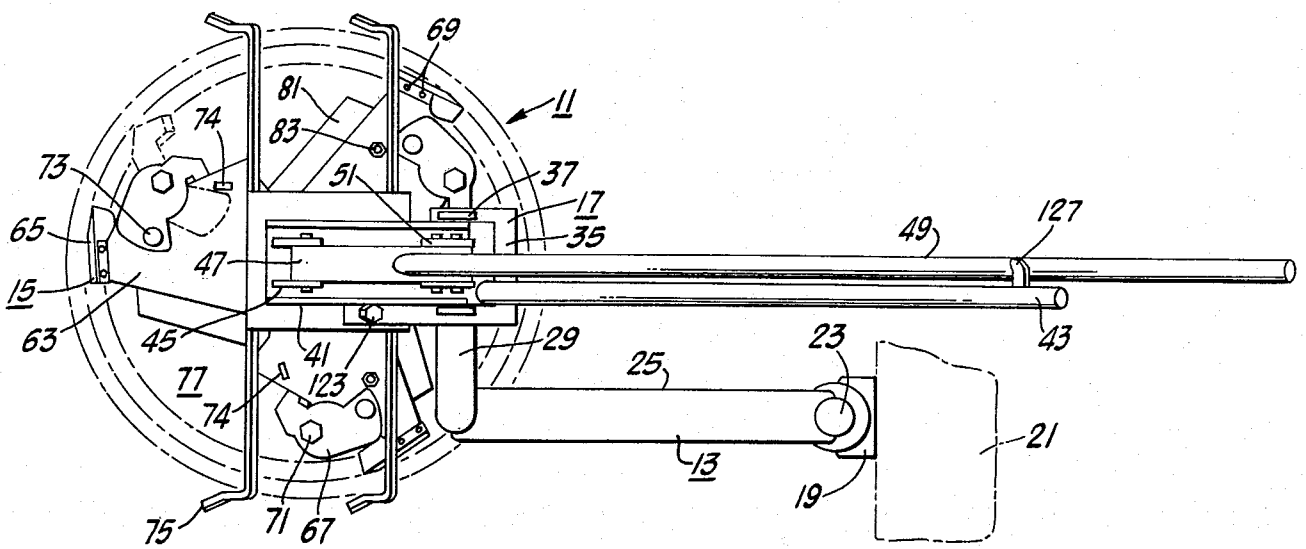
FIG. 3 is a plan view of the apparatus, as viewed in FIG. 2.

As shown in FIG. 2, a heat shield 81, comprising a flat metal member, is suitably connected, as by bolts 83 and spacers 85, in spaced apart relation to the plate 63. The heat shield 81 is thereby removable and replaceable, and it rotates with an protects the plate 63 and cleaning mechanisms 65, 67 from heat emerging from the ascension pipe opening 77 and lid 79.

Figure 1A:
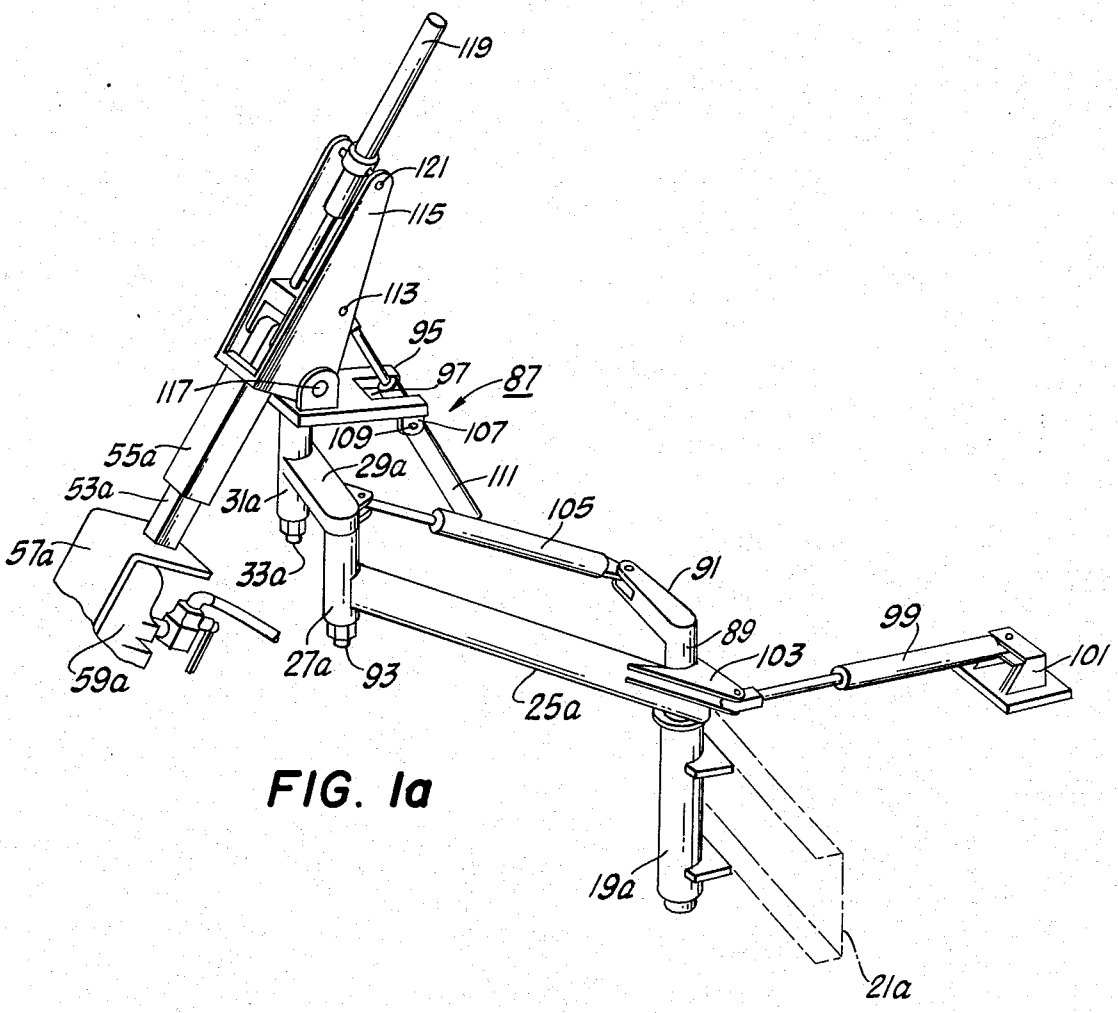
FIG. 1*a* is a schematic perspective view of apparatus similar to but showing a modification in the apparatus of FIG. 1.

FIG. 1*a* illustrates a portion of apparatus 87 that is very like apparatus 11 except that apparatus 87 is actuated by fluid-actuated or electrically actuated units. The cleaning portion of apparatus 87 that is not shown, is identical with the cleaning portion of apparatus 11 shown in FIG. 1.

It will be noticed from FIG. 1*a* that a sleeve 19*a* is fixed to a larry car 21*a*, and the sleeve 19*a* carries a pin 89 that is pivotable therein and that is connected to an arm 91. The pin 81 holds a horizontal arm 25*a*, like arm 25 in FIG. 1, and the arm 25*a* supports at its outer end a vertically oriented sleeve 27*a*.

The sleeve 27*a* surrounds a pin 93 to which is fixed a horizontal arm 29*a*. The arm 29*a* is fixed to a vertical sleeve 31*a* in which pin 33*a* resides. The pin 33*a* carries on its upper end a horizontal rectangular shaped platform 95, that has a small slot 97 in one edge.

The arm 25*a* and pin 89 are rotatable about a vertical axis in pin 89 by means of a fluid-actuated cylinder-piston assembly, or electrically actuated operator 99 secured to a bracket 101 mounted to the larry car 21*a* and to lugs 103 mounted to the pin 89 and arm 25*a*.

The arm 91 also connects to an operator 105 which connects to the arm 29*a*.

The platform 95 carries on its underneath side a pair of lugs 107 which journal a shaft 109 supporting an actuator 111. The actuator 111 is pivotally secured by a pin 113 to a pivotable frame 115. The pivotable frame 115 is, as shown in FIG. 1*a*, pivotally mounted as at 117 to the platform 95.

The pivotable frame 115, as shown, supports an actuator 119 on shaft 121, and the actuator 119 connects to a thrust rod 53*a* operating in sleeve 55*a* which is fixed to the pivotable frame 115.

As shown in FIG. 1*a*, the thrust rod 53*a* is fixed to a frame 57*a* on which, like the frame 57 of FIG. 1, is mounted an air motor 59*a*, or like apparatus.

In operating the apparatus of FIG. 1 or FIG. 1*a* an operator standing on on the larry car 21 positions the cleaning apparatus 11 or 87 over the ascension pipe opening 77 and lowers the cleaning apparatus by pivoting lever 49 downward. The pivotable frame 41 is provided with an adjustable screw 123 which engages the platform 35 and the pivotable frame 41 will have been previously placed in a proper angular attitude so that the cleaning apparatus is aligned axially, as nearly as possible, with the ascension pipe opening 77.

The operator lowers the cleaning mechanism until the guides 75 contact the sides of the ascension pipe adjacent opening 77. The first set of cleaning heads 65 then contact the lid seat in the ascension pipe opening 77. The second set of cleaners 67, of course, will have previously been put in the inoperative position, since they are used only for cleaning the ascension pipe lid 79.

Then, the operator, by pressing a foot valve or switch 125, mounted on the larry car, actuates the air motor 59 (which may be an electric or hydraulic motor). The cleaning heads 65 then rotate while force is applied against the lid seat by the operator pressing downward on the lever 49.

While cleaning the lid seat, the angle of tilt of the cleaning mechanism can be adjusted by moving the lever 43 up or down and adjusting the screw 123 accordingly. Since the entire cleaning mechanism is pivotable about vertical axes in sleeves 19 and 27, the mechanism can be adjusted also laterally as well as up and down.

When the lid seat is cleaned sufficiently, the operator stops the air motor and raises the cleaning mechanism by lifting lever 49. The lever 49 can then engage a hook 127 on the lever 43 in a hold position.

Thereafter the two levers 43, 49, acting together, are pressed downward while the mechanism is oriented toward the ascension pipe lid 79, situated in the raised position, as shown in FIG. 2. The three retractable or pivotable lid scrapers 67 are then either manually or mechanically pivoted to the operating position, in which position they are held by the stop lugs 74.

Whereupon, the operator then presses the lever 49 downward so as to press the cleaning heads 67 onto the lid seat and then, by pressing the foot valve or switch 125 he actuates the cleaning mechanism 67 relative to the lid seat. The guides 75, of course, orient and direct the cleaning mechanism 67 toward the lid seat.

As described previously, the angle of tilt and scraping pressure, and the general orientation of the mechanism can be regulated by manipulating the levers 43 and 49.

When the lid is cleaned, the operator stops the motor and the entire mechanism is pivoted away from the ascension pipe and is secured in a stowed position on the larry car.

Those skilled in the art will understand that the operator, instead of manipulating the levers and foot valve or switch, may by using the apparatus of FIG. 1*a* operate controls on a panel suitably mounted on the larry car. Then, the cleaning operations will be accomplished mechanically, using the actuating devices described and shown herein.

From the foregoing description of apparatus and a modified apparatus in accordance with the invention, those skilled in the art should recognize many important features and advantages thereof, among which the following are particularly significant:

That the cleaning apparatus is readily available and can be quickly and easily operated to clean a lid and pipe seat within the average stopping time of a larry car when charging a coke oven;

That the cleaning apparatus, being pivotally supported, can be quickly and easily maneuvered to suit a lid and ascension pipe seat;

That the cleaning units or scrapers can be readily removed and replacements installed quickly and with dispatch without having to remove the apparatus from the larry car; and That the apparatus is readily adaptable to existing coke oven batteries and can be operated manually or mechanically.

Although the invention has been described herein with a certain degree of particularity it is understood that the present disclosure has been made only as an example and that the scope of the invention is defined by what is hereinafter claimed.

What is claimed is:

1. In a coke oven battery whereon a larry car travels, apparatus for cleaning seating surfaces of lids and openings of ascension pipes on said battery comprising:

a. a first support pivotally mounted to said larry car;
b. a guide pivotally mounted to said first support;
c. a rod reciprocably disposed in said guide;
d. a second support carried by said rod;
e. first and second means mounted to a rotatable mechanism mounted to said second support for coacting with and cleaning said seating surfaces;
f. third means for reciprocating said rod; and
g. fourth means for pivoting said guide and bringing said first and second means into position for coacting with said seating surfaces.

2. The invention of claim 1 wherein:

a. said first means coacts with and cleans the seating surfaces of the openings in said ascension pipe; and
b. said second means coacts with and cleans the seating surfaces of the lids on said ascension pipes.

3. The invention of claim 1 including:

a. means for shielding said first and second means from heat.

4. The invention of claim 1 wherein:

a. said rotatable mechanism is a motor.

5. In a coke oven battery whereon a larry car travels, apparatus for cleaning seating surfaces of lids and openings of ascension pipes on said battery comprising:

a. a first support member mounted to said larry car;
b. a platform swivelly mounted to said first support member;
c. a guide mounted to;
d. a frame pivotally mounted to said platform and carrying a rod slidably disposed in said guide;
e. a second support member mounted to said rod and supporting a rotatable element having an output shaft to which is mounted
f. a third support member;
g. a first set of cleaning tools mounted to said third support member;
h. a second set of cleaning tools adjustably mounted to said third support member in spaced-angular relation to said first cleaning tools; and
i. means for manipulating said apparatus so as to bring said cleaning tools into and out of engagement with said seating surfaces.

6. The invention of claim 5 including a. means for actuating said rotatable element.

7. The invention of claim 5 including:

a. a heat shield mounted to said third support member.

8. The invention of claim 5 including:

a. means for pivoting said frame.

9. The invention of claim 5 including:

a. an arm journaled in said first support member and pivotally mounted to said platform whereby said platform is swivelly mounted.

10. The invention of claim 9 including:

a. means connected to said arm for swiveling said platform.

11. In a coke oven battery whereon a larry car travels, apparatus for cleaning seating surfaces of lids and openings of ascension pipes on said battery comprising:

a. a first support member mounted to said larry car;

b. an arm pivotally journaled in said first support member;

c. a platform mounted to said arm;

d. means for pivoting said arm;

e. a guide mounted to;

f. a frame pivotally mounted to said platform and carrying a rod slidably disposed in said guide;

g. a second support member mounted to said rod and supporting a rotatable element having an output shaft to which is mounted h. a third support member;

i. a first set of cleaning tools mounted to said third support member;

j. a second set of cleaning tools adjustably mounted to said third support member in spaced angular relation to said first set of cleaning tools;

k. means for actuating said rotatable element;

l. means for adjusting said second set of cleaning tools relative to one of said surfaces;

m. means for pivoting said frame; and n. means for reciprocating said rod so that said cleaning tools engage and disengage with said seating surfaces.

12. The invention of claim 11 including:

a. a heat shield mounted to and spaced apart from said third support member.

13. The invention of claim 11 wherein:

a. said means for pivoting said arm is mounted to said larry car.

14. The invention of claim 13 wherein:

a. said means for pivoting said frame is mounted to said platform.

* * * * *